US005702278A

United States Patent [19]

Boucher

[11] Patent Number: 5,702,278

[45] Date of Patent: Dec. 30, 1997

[54] TOWABLE WATERCRAFT

[76] Inventor: Erin Boucher, 21 Hemlock Hill Rd., Amherst, N.H. 03031

[21] Appl. No.: 747,645

[22] Filed: Nov. 13, 1996

[51] Int. Cl.[6] ..... B63B 1/00

[52] U.S. Cl. ..... 441/66; 114/345

[58] Field of Search ..... 441/65, 66, 79, 441/35, 40; 114/345, 253, 254; D21/228

[56] References Cited

U.S. PATENT DOCUMENTS

| | | | |
|---|---|---|---|
| 3,657,753 | 4/1972 | LeBlanc, Sr. | 9/310 F |
| 3,664,290 | 5/1972 | Finn | 115/20 |
| 3,779,201 | 12/1973 | Spahn | 115/20 |
| 3,803,652 | 4/1974 | Uyehara | 9/310 E |
| 3,918,114 | 11/1975 | Schmitt | 441/79 |
| 4,427,394 | 1/1984 | Felter | 441/66 |
| 4,451,239 | 5/1984 | Hoenstine et al. | 441/66 |
| 4,552,539 | 11/1985 | Hoenstine et al. | 441/66 |
| 4,606,728 | 8/1986 | Simpson | 441/66 |
| 4,619,620 | 10/1986 | Felter | 441/66 |
| 4,619,621 | 10/1986 | Coleman, IV | 441/66 |
| 4,807,554 | 2/1989 | Chi-Hung | 114/345 |
| 4,820,219 | 4/1989 | Fortier, Jr. et al. | 441/66 |
| 4,886,476 | 12/1989 | Brocone et al. | 441/65 |
| 5,006,087 | 4/1991 | Peterson | 441/66 |
| 5,122,086 | 6/1992 | Remy | 441/66 |
| 5,383,804 | 1/1995 | Mitch et al. | 441/66 |

*Primary Examiner*—Ed L. Swinehart

*Attorney, Agent, or Firm*—Hamilton, Brook, Smith & Reynolds, P.C.

[57] ABSTRACT

A towable watercraft includes an inflatable triangular shaped watercraft body having top and bottom surfaces which are located on opposite sides of the body. The body also includes front and rear ends with a central axis extending from the front end to the rear end bisecting the body into first and second sections. A towing fixture is affixed to the front end of the body. A first steering fin is positioned on the bottom surface of the first section and a second steering fin is positioned on the bottom surface of the second section. A first handle unit is positioned on the top surface at the front end of the first section and a second handle unit is positioned on the top surface at the front end of the second section.

16 Claims, 4 Drawing Sheets

TOWABLE WATERCRAFT

BACKGROUND

Inflatable inner tubes are commonly pulled behind power boats with a tow line for recreational purposes. Most inner tubes for this purpose are traditionally doughnut shaped. The rider can lie across the top of the inner tube or sit within the central cavity. Usually, the inner tube includes handles which the rider can grip while riding the inner tube. In addition, a fabric sheath typically surrounds the tube, covering the bottom of the central cavity in order to make the inner tube more streamlined.

A limitation of such an inner tube is that it has limited maneuverability. When the boat towing the inner tube is traveling in a curved path, centrifugal force lets the tube travel well outside the wake of the boat. However, when the boat is traveling in a straight path, the rider cannot maneuver the tube outside the wake.

SUMMARY OF THE INVENTION

The present invention provides a towable watercraft that is more maneuverable than previous inner tubes allowing the rider to steer the present invention watercraft well outside the wake of the boat.

The towable watercraft of the present invention includes a watercraft body having top and bottom surfaces which are located on opposite sides of the body. The body also includes a front end or bow and a rear end or stern. A central axis extends from the front end to the rear end to bisect the body into first and second sections. A towing fixture is affixed to the front end of the body for securing the watercraft to a towline. A first steering fin is positioned on the bottom surface of the first section. A second steering fin is positioned on the bottom surface of the second section. A first handle unit is positioned on the top surface at the front end of the first section and a second handle unit is positioned on the top surface at the front end of the second section.

In preferred embodiments, the watercraft body is inflatable and is roughly triangular shaped. The first and second fins are positioned near the outer edges of the first and second sections and are angled outwardly. The first and second handle units each include two handles which are positioned side by side. In one preferred embodiment, the first and second steering fins are asymmetrically shaped with each steering fin having an inner face which is perpendicular to the bottom surface at the area immediately surrounding the steering fin and an outer surface which angles gradually outward.

In order to steer the present invention watercraft when towed by a boat, the rider shifts body weight onto the first section of the watercraft body to engage the first fin in the water for steering the watercraft in a first direction. The rider can also shift body weight onto the second section of the watercraft body to engage the second fin in the water for steering the watercraft in a second direction. If the rider merely wishes to travel in a straight path, the rider maintains body weight along the central axis of the watercraft.

The towable watercraft of the present invention is more fun and exciting to ride than previous towable inner tubes because the watercraft is more maneuverable and can be steered well outside the wake of the boat.

BRIEF DESCRIPTION OF THE DRAWINGS

The foregoing and other objects, features and advantages of the invention will be apparent from the following more particular description of preferred embodiments of the drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENTS

Figure 1:
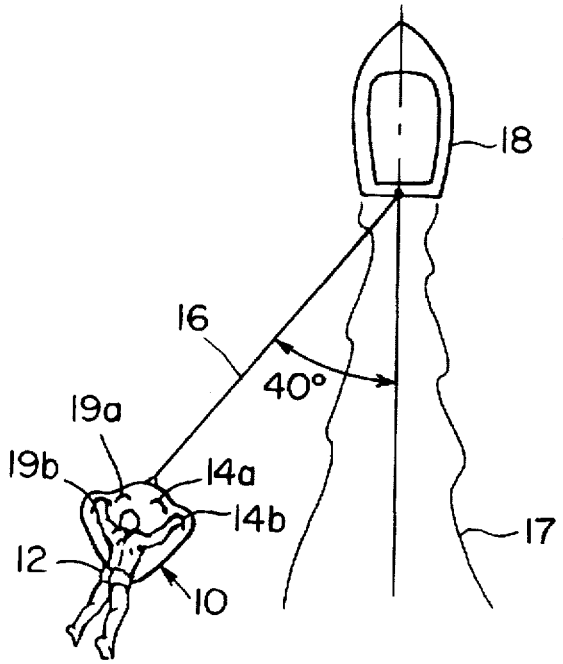
FIG. 1 is a plan view of the present invention towable watercraft being towed by a motor boat.

FIG. 1 depicts the present invention watercraft 10 being towed through the water by a motor boat 18 with a tow line 16. A rider 12 rides on top of watercraft 10 and holds onto a series of handles 14*a*, 14*b*, 19*a* and 19*b*. FIG. 1 depicts watercraft 10 being steered by rider 12 outside the wake 17 of motor boat 18. Watercraft 10 can be steered to either side of wake 17 as well as within wake 17.

Figure 2:
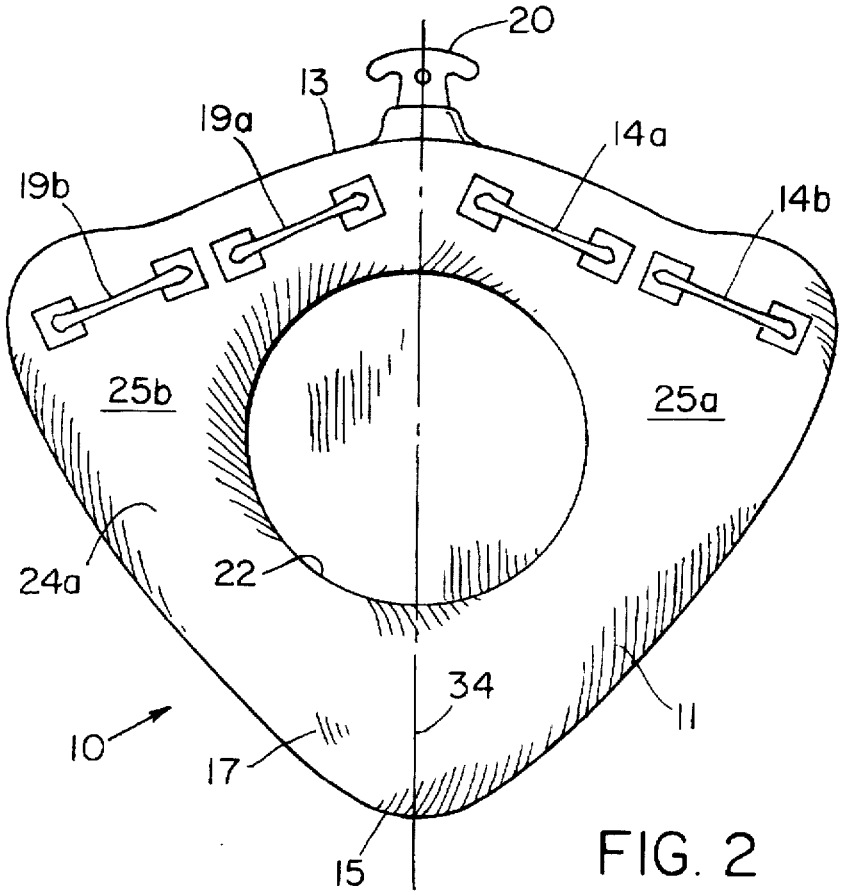
FIG. 2 is a top view of the present invention towable watercraft.
Figure 3:
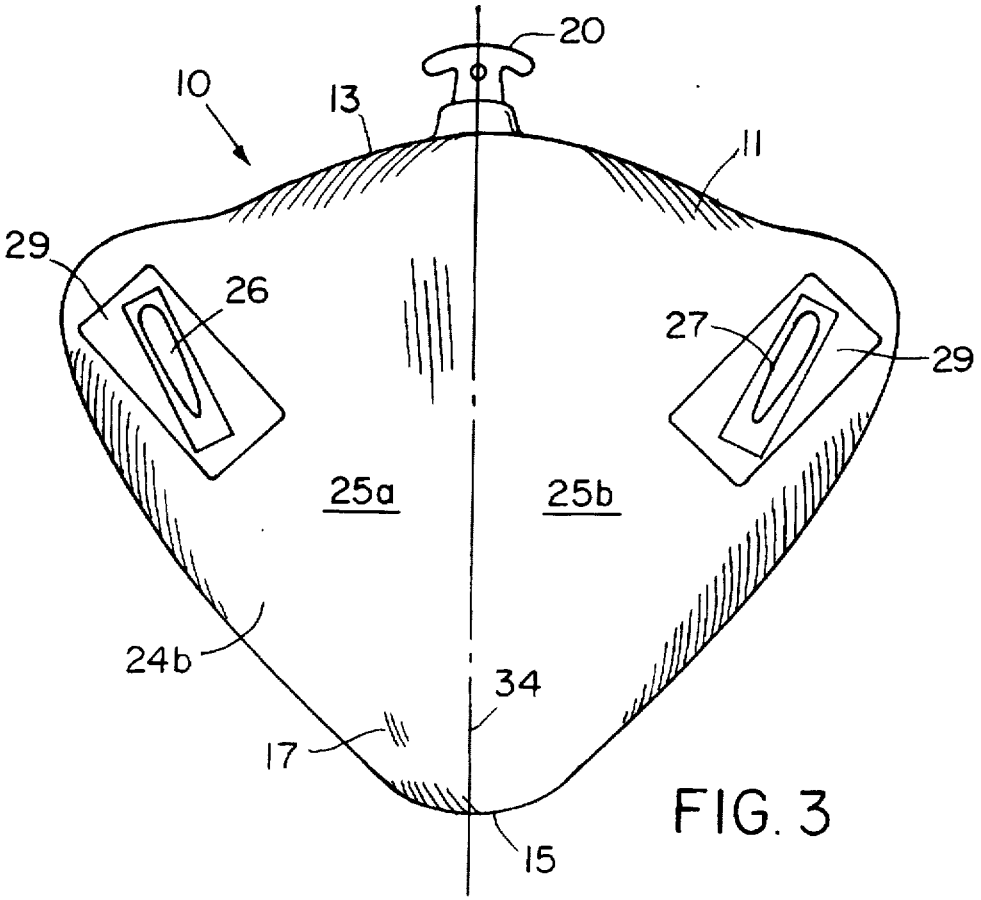
FIG. 3 is a bottom view of the present invention towable watercraft.
Figure 4:
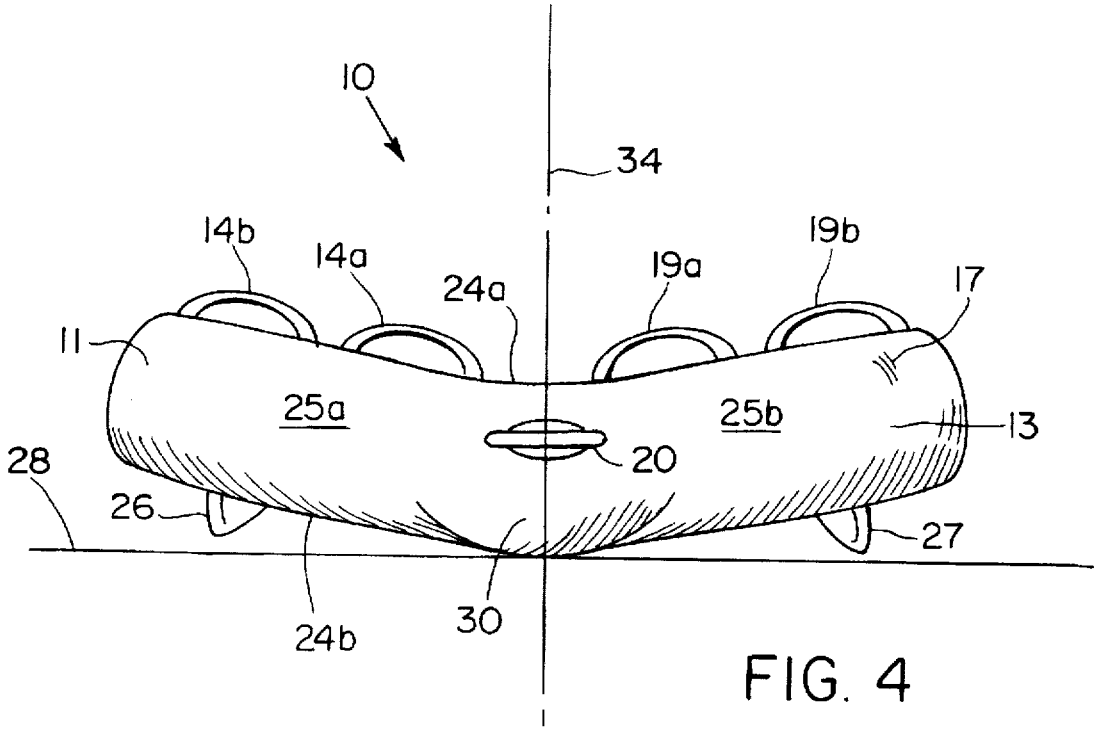
FIG. 4 is a front view of the towable watercraft in a non-turning position.

Referring to FIGS. 2, 3 and 4, watercraft 10 has an inflatable body 11 that is roughly triangular in shape with the bow or front end 13 of body 11 forming one leg of the triangle. The sides of body 11 form the other two legs of the triangle with the stern or rear end 15 of body 11 coming roughly to a point. The triangular shape of body 11 is more maneuverable than circular inner tubes. Body 11 has a central cavity 22 which is similar to those found in traditional inner tubes. Body 11 is preferably about 42 inches long, 48 inches wide, and 12 inches thick and is formed from welded polyvinylchloride (PVC).

A sheath or cover 17 extends around body 11 and covers the bottom of central cavity 22. Cover 17 is preferably made of nylon and is covered by neoprene on the top sections for comfort. A towing fixture 20 is mounted to the bow 13 for securing watercraft 10 to tow line 16. Body 11 has a central axis 34 which extends from bow 13 to stern 15 and bisects body 11 into starboard and port sections 25*a* and 25*b*. Handles 14*a*/14*b* are mounted to cover 17 on the top surface 24*a* of body 11 on the starboard section 25*a* near the bow 13. Handles 19*a*/19*b* are mounted to cover 17 on the top surface 24*a* of body 11 on the port section 25*b* near the bow 13. Handles 14*a*, 14*b*, 19*a* and 19*b* preferably have a foam padding core and a nylon fabric covering, but alternatively, can be made of plastic or rubber. Handles 14*a*, 14*b*, 19*a* and 19*b* each have a grip that is preferably about 6 inches long.

Figure 5:
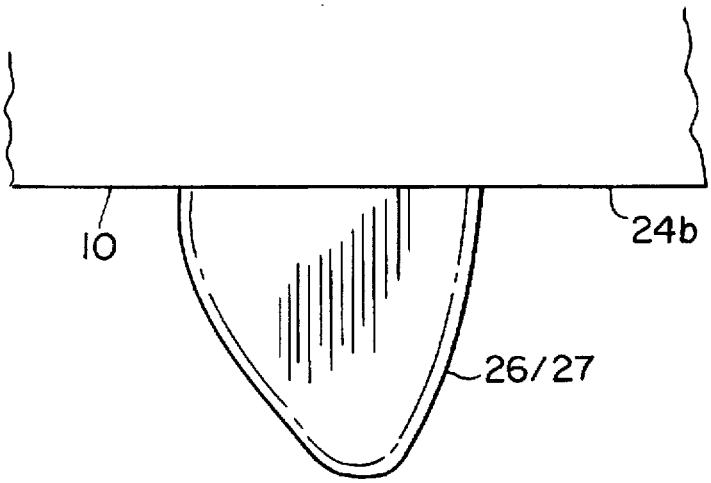
FIG. 5 is a side view of the preferred steering fin for the watercraft.

Two downwardly extending steering fins 26 and 27 are positioned on the bottom surface 24*b* of body 11 on opposite sides of central axis 34. Fin 26 is positioned near the outer edge of the starboard section 25*a* and fin 27 is positioned near the outer edge of the port section 25*b*. Fins 26 and 27 preferably angle outwardly away from central axis 34 toward the bow 13 of body 11. In addition, fins 26 and 27 have a streamlined profile resembling a foil or lift surface and are made of an elastomer such as rubber or urethane that is rigid enough to retain its shape but soft enough not to cause personal injury. Referring to FIG. 5, fins 26 and 27 are roughly triangular shaped with a blunt end. Fins 26 and 27 extend downwardly preferably between about 3 and 6 inches.

The towing fixture 20, handles 14*a*/14*b* and 19*a*/19*b* as well as fins 26/27 preferably have fabric flanges which are stitched to cover 17 or bonded with an adhesive. Alternatively, a plastic welding process can be employed. Two backing plates 29 are secured to cover 17 to provide flat mounting surfaces for fins 26/27. Backing plates 29 also increase the stiffness of fins 26/27 relative to body 11. In an alternative embodiment, towing fixture 20, handles 14*a*/14*b* and 19*a*/19*b* and fins 26/27 are directly secured to body 11 by an adhesive. In such a case, cover 17 is provided with apertures at those locations through which the components can protrude.

The following description describes the use of watercraft 10 while motor boat 18 is traveling in a straight path to emphasize the steering ability of watercraft 10. In use, the rider 12 lies on body 11 with his/her head facing the bow 13. When the rider 12 is positioned in the center of the watercraft 10, the body 11 of watercraft 10 bends slightly in the middle creating a V-shaped bottom such that fins 26 and 27 are raised above the surface of the water 28. Optionally, an inflatable central portion 30 can also be used to raise fins 26 and 27 above the water surface 28 (FIG. 4) as well as to increase rider comfort and improve steering ability. In order to travel in a straight path, rider 12 lies along the central axis 34 of body 11 and grips handles 14*a* and 19*a*. Typically, when traveling in a straight path, watercraft 10 travels within the wake 17 of motor boat 18 (FIG. 1).

Figure 6:
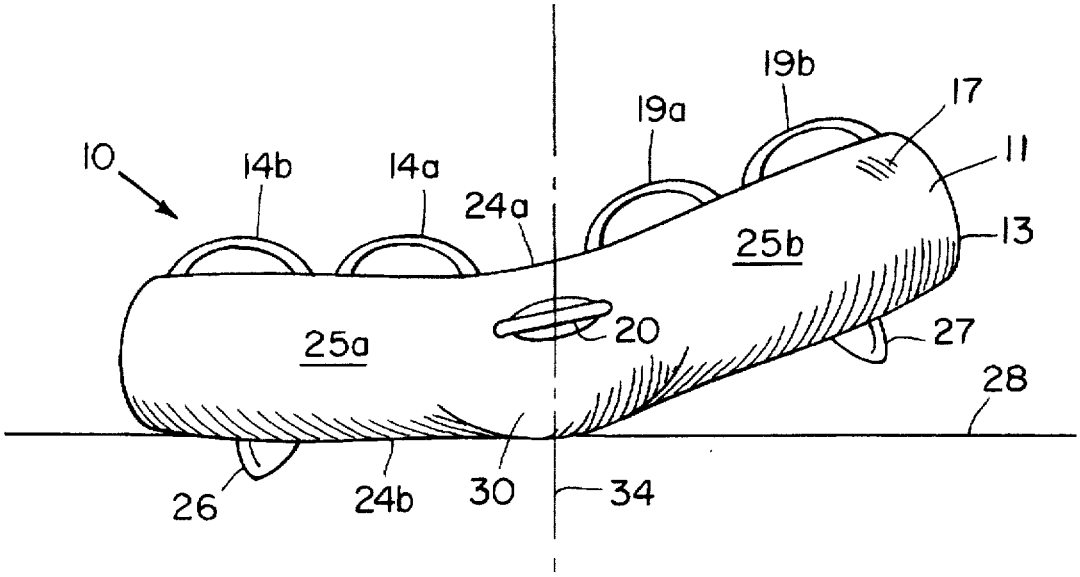
FIG. 6 is a front view of the towable watercraft positioned for turning.

If rider 12 wishes to steer watercraft 10 to the right or starboard side, rider 12 grips handles 19*a*/14*b* and shifts his/her weight to the starboard section 25*a* of the body 11 leaning on his/her right elbow and hip. This puts pressure on and pushes the starboard section 25*a* down onto the water 28 and fin 26 into the water 28, thereby tilting watercraft 10 to the starboard side (FIG. 6). At the same time, the port section 25*b* and fin 27 are further raised above water 28. Fin 26 engages water 28 and since fin 26 is angled slightly outwardly, watercraft 10 is steered to the right or starboard side by fin 26.

In order to steer watercraft 10 to the left or port side, the rider 12 grips handles 14*a*/19*b* and shifts his/her weight to the port section 25*b* on other side of central axis 34 leaning on his/her left elbow and hip as seen in FIG. 1. This puts pressure on and pushes the port section 25*b* down onto the water 28 and fin 27 into the water 28, thereby tilting watercraft 10 to the port side. At the same time, the starboard section 25*a* and fin 26 are raised out of the water 28. Fin 27 engages water 28 and steers watercraft 10 to the left or port side in the same manner as described with regard to fin 26. The operation of fins 26 and 27 with handles 14*a*/14*b* and 19*a*/19*b* allow watercraft 10 to be steered at a 40° degree angle relative to motor boat 18 when the motor boat 18 is traveling in a straight path.

Figure 7:
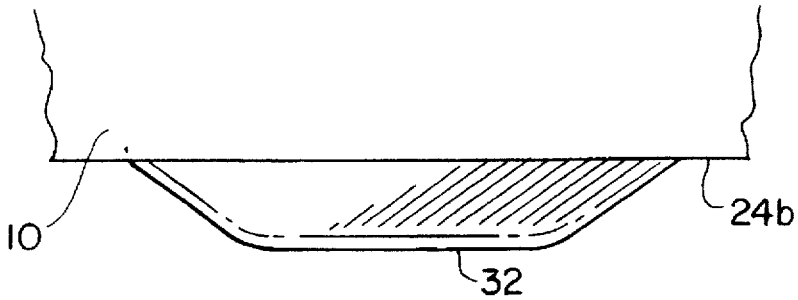
FIG. 7 is a side view of another preferred steering fin.

Referring to FIG. 7, fin 32 is another preferred fin. Fin 32 is longer in length but does not extend downwardly as far as fins 26 and 27.

Figure 8:
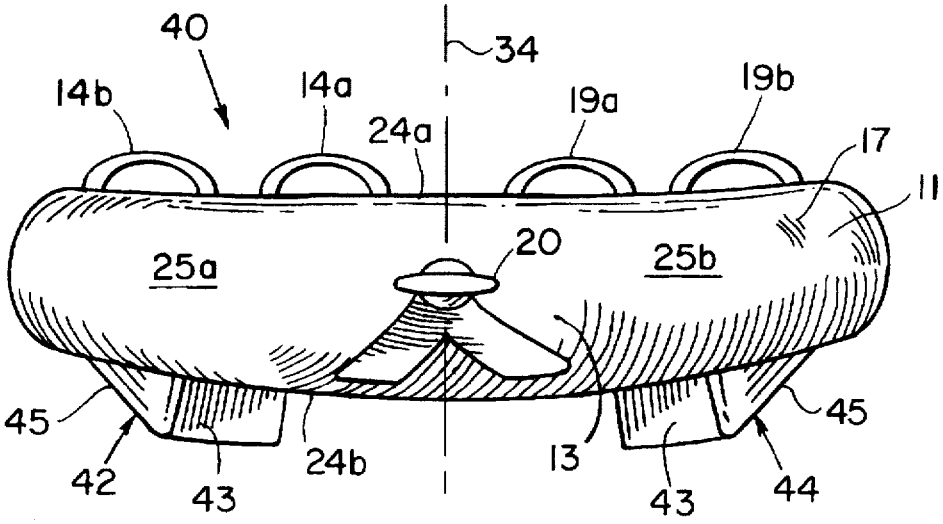
FIG. 8 is a front view of another preferred towable watercraft.
Figure 9:
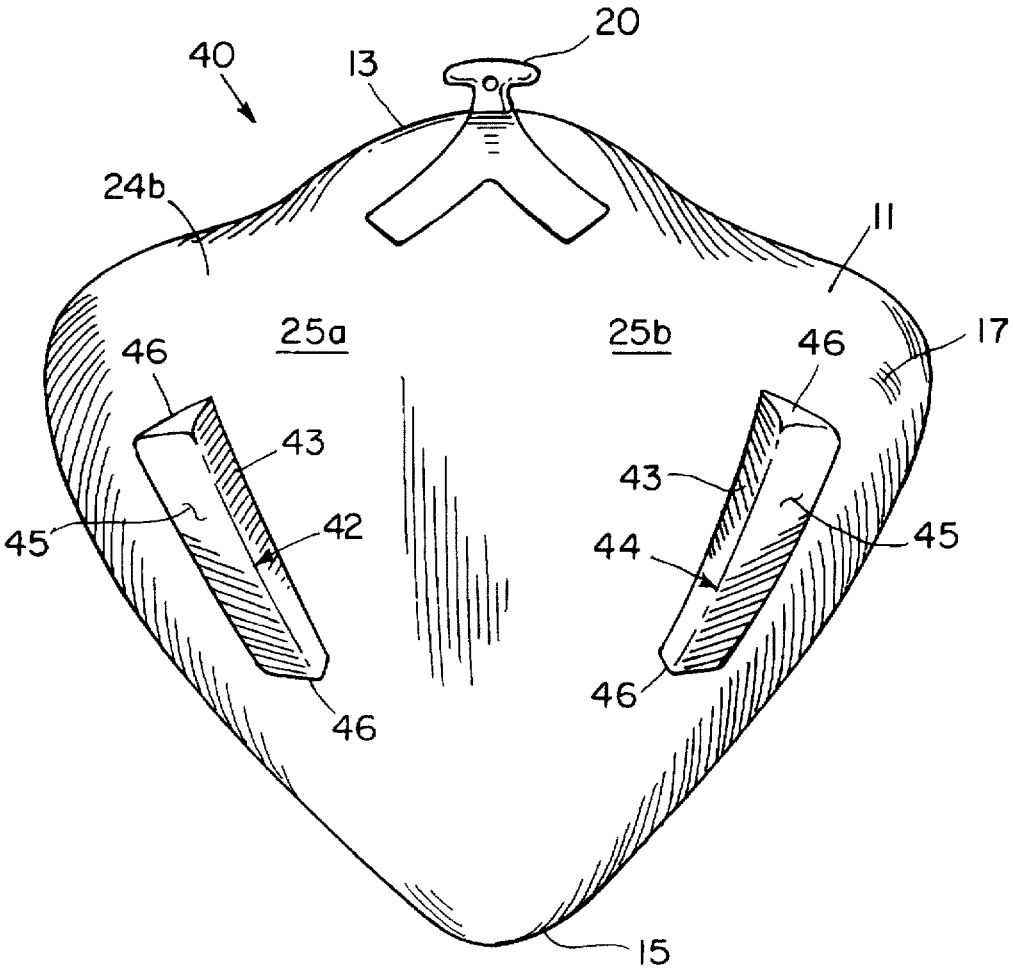
FIG. 9 is a bottom view of the towable watercraft of FIG. 8.

FIGS. 8 and 9 depict another preferred watercraft 40. Watercraft 40 differs from watercraft 10 in that watercraft 40 includes two steering fins 42 and 44 having inner faces 43 that are perpendicular to the attachment points on bottom surface 24*b* and declining outer surfaces 45 which gradually angle outwardly to meet bottom surface 24*b*. This fin design is stronger than the design of fins 26/27 and allows fins 42 and 44 to be made of softer material than fins 26/27. A softer material lessens the possibility of injury to a person if struck by fins 42/44. In addition, the ends 46 of fins 42/44 are rounded for safety. The bottom edge of fins 42/44 where surfaces 43/45 meet preferably has a radius of ⅛ to ¼ inches, but alternatively, the radius can be larger. The declining surfaces 45 allow watercraft 40 to traverse laterally in the water without engaging the non-turning fin in the water. The asymmetrical shape of fins 42/44 makes watercraft 40 perform better than watercraft 10 when induced to travel outside the wake 17 by motor boat 18.

Equivalents

While this invention has been particularly shown and described with references to preferred embodiments thereof, it will be understood by those skilled in the art that various changes in form and details may be made therein without departing from the spirit and scope of the invention as defined by the appended claims. Although watercrafts 10 and 40 have been described as having flexible bottom surfaces, alternatively, the bottom surfaces can be rigid. In addition, although two handles are shown to be located on each section 25*a* and 25*b* of watercrafts 10 and 40, alternatively, one handle or more than two handles can be positioned on each section 25*a*/25*b*. Furthermore, although the body 11 of watercrafts 10 and 40 are shown to be triangular, the respective bodies can have other suitable shapes although non-circular shapes are preferable. Also, although particular dimensions have been described for various features of watercrafts 10 and 40, these dimensions can vary depending upon the size, the performance desired, or whether the watercrafts are built for carrying two riders.

What is claimed is:

1. A towable watercraft comprising:

a watercraft body having top and bottom surfaces which are located on opposite sides of the body, the body also including front and rear ends, a central axis extending from the front end to the rear end bisecting the body into first and second sections, the body in use having a roughly v-shaped bottom;

a towing fixture affixed to the front end of the body;

a first steering fin positioned on the bottom surface of the first section;

a second steering fin positioned on the bottom surface of the second section, said v-shaped bottom allowing the first and second fins to be alternately engagable in water for turning;

a first handle unit positioned on the top surface at the front end of the first section; and a second handle unit positioned on the top surface at the front end of the second section.

2. The watercraft of claim 1 in which the body is inflatable.

3. The watercraft of claim 2 in which the body is of non-circular shape.

4. The watercraft of claim 3 in which the body is roughly triangular shaped.

5. The watercraft of claim 1 in which the first and second sections each have an outer edge, the first and second fins being positioned near the outer edges of the first and second sections.

6. The watercraft of claim 1 in which the first and second handle units each comprise two handles which are positioned side by side.

7. The watercraft of claim 1 in which the first and second steering fins are angled frontwardly outwardly.

8. The watercraft of claim 1 in which the first and second steering fins are asymmetrically shaped.

9. The watercraft of claim 8 in which each steering fin has an inner face which is perpendicular to the bottom surface at the area immediately surrounding the steering fin and an outer surface which angles gradually outward.

10. A towable watercraft comprising:

a non-circular inflatable body having top and bottom surfaces which are located on opposite sides of the body, the body also including front and rear ends, a central axis extending from the front end to the rear end bisecting the body into first and second sections, the body in use having a roughly v-shaped bottom;

a towing fixture affixed to the front end of the body;

a first steering fin positioned on the bottom surface of the first section;

a second steering fin positioned on the bottom surface of the second section, said v-shaped bottom allowing the first and second fins to be alternately engagable in water for turning;

a first handle unit positioned on the top surface at the front end of the first section, the first handle unit comprising two handles which are positioned side by side; and a second handle unit positioned on the top surface at the front end of the second section, the second handle unit comprising two handles which are positioned side by side.

11. The watercraft of claim 10 in which the body is roughly triangular shaped.

12. The watercraft of claim 10 in which the first and second sections each have an outer edge, the first and second fins being positioned near the outer edges of the first and second sections.

13. The watercraft of claim 10 in which the first and second steering fins are angled frontwardly outwardly.

14. A method of steering a towable watercraft being towed by a boat with a towline through water, the watercraft comprising a watercraft body on which a rider rides having top and bottom surfaces located on opposite sides of the body, the body also including front and rear ends, a central axis extending from the front end to the rear end bisecting the body into first and second sections, the body in use having a roughly v-shaped bottom, a towing fixture affixed to the front end of the body for securing the watercraft to the towline, a first steering fin positioned on the bottom surface of the first section and a second steering fin positioned on the bottom surface of the second section, said v-shaped bottom allowing the first and second fins to be alternately engagable in water for turning, a first handle unit positioned on the top surface at the front end of the first section and a second handle unit positioned on the top surface at the front end of the second section, the method comprising the step of:

shifting the rider's body weight onto the first section of the watercraft body to engage only the first fin in the water for steering the watercraft in a first direction.

15. The method of claim 14 further comprising the step of shifting the rider's body weight onto the second section of the watercraft body to engage only the second fin in the water for steering the watercraft in a second direction.

16. The method of claim 14 further comprising the step of maintaining the rider's body weight along the central axis for maintaining the watercraft in a straight path.

* * * * *